US007839015B2

(12) United States Patent
Hermann et al.

(10) Patent No.: US 7,839,015 B2
(45) Date of Patent: Nov. 23, 2010

(54) CIRCUIT ARRANGEMENT HAVING A POWER SUPPLY UNIT

(75) Inventors: Wolfgang Hermann, Tennenbronn (DE); Michael Meitzner, Pfaffenweiler (DE); Jean-Paul Louvel, Brigachtal (DE)

(73) Assignee: Thomson Licensing, Boulogne-Billancourt (FR)

( * ) Notice: Subject to any disclaimer, the term of this patent is extended or adjusted under 35 U.S.C. 154(b) by 972 days.

(21) Appl. No.: 10/585,535

(22) PCT Filed: Dec. 28, 2004

(86) PCT No.: PCT/EP2004/014763

§ 371 (c)(1),
(2), (4) Date: Jul. 10, 2006

(87) PCT Pub. No.: WO2005/069468

PCT Pub. Date: Jul. 28, 2005

(65) Prior Publication Data

US 2009/0184584 A1 Jul. 23, 2009

(30) Foreign Application Priority Data

Jan. 8, 2004 (DE) ..... 10 2004 001 296

(51) Int. Cl.
*G05F 1/10* (2006.01)
*H02J 1/14* (2006.01)

(52) U.S. Cl. ..... 307/30; 323/234

(58) Field of Classification Search ..... 307/30, 307/31, 130; 323/234, 265, 282
See application file for complete search history.

(56) References Cited

U.S. PATENT DOCUMENTS

| | | | | |
|---|---|---|---|---|
| 4,257,092 | A * | 3/1981 | Prines et al. | 363/124 |
| 4,381,479 | A * | 4/1983 | Wesling et al. | 388/811 |
| 5,592,034 | A | 1/1997 | Felmus et al. | |
| 6,420,906 | B1 * | 7/2002 | Kohda | 326/114 |
| 6,500,152 | B1 | 12/2002 | Illi | |
| 6,650,552 | B2 * | 11/2003 | Takagi et al. | 363/17 |
| 2001/0039626 | A1 | 11/2001 | Jauert | |

FOREIGN PATENT DOCUMENTS

| | | |
|---|---|---|
| CN | 1326260 | 12/2001 |
| EP | 0551811 | 7/1993 |

(Continued)

OTHER PUBLICATIONS

Search Report Dated Apr. 8, 2005.

*Primary Examiner*—Albert W Paladini
(74) *Attorney, Agent, or Firm*—Robert D. Shedd; Joseph J. Opalach; Brian J. Cromarty

(57) ABSTRACT

The circuit arrangement has a power supply unit, a mains switch and a switching element, for example a relay, that bridges a first switching contact of the mains switch. A load is coupled to a control terminal of the switching element, so that when the control voltage is turned off for the purpose of opening the switching element, the load is simultaneously turned off. The circuit arrangement contains a microprocessor, in particular, which is supplied with an operating voltage by the power supply unit, and which is coupled to the control terminal of the switching element for control of the switching element. The load is a fan, for example, which is switched off in a delayed manner when the circuit arrangement is switched off by means of the mains switch.

12 Claims, 2 Drawing Sheets

FOREIGN PATENT DOCUMENTS

Figure 1:
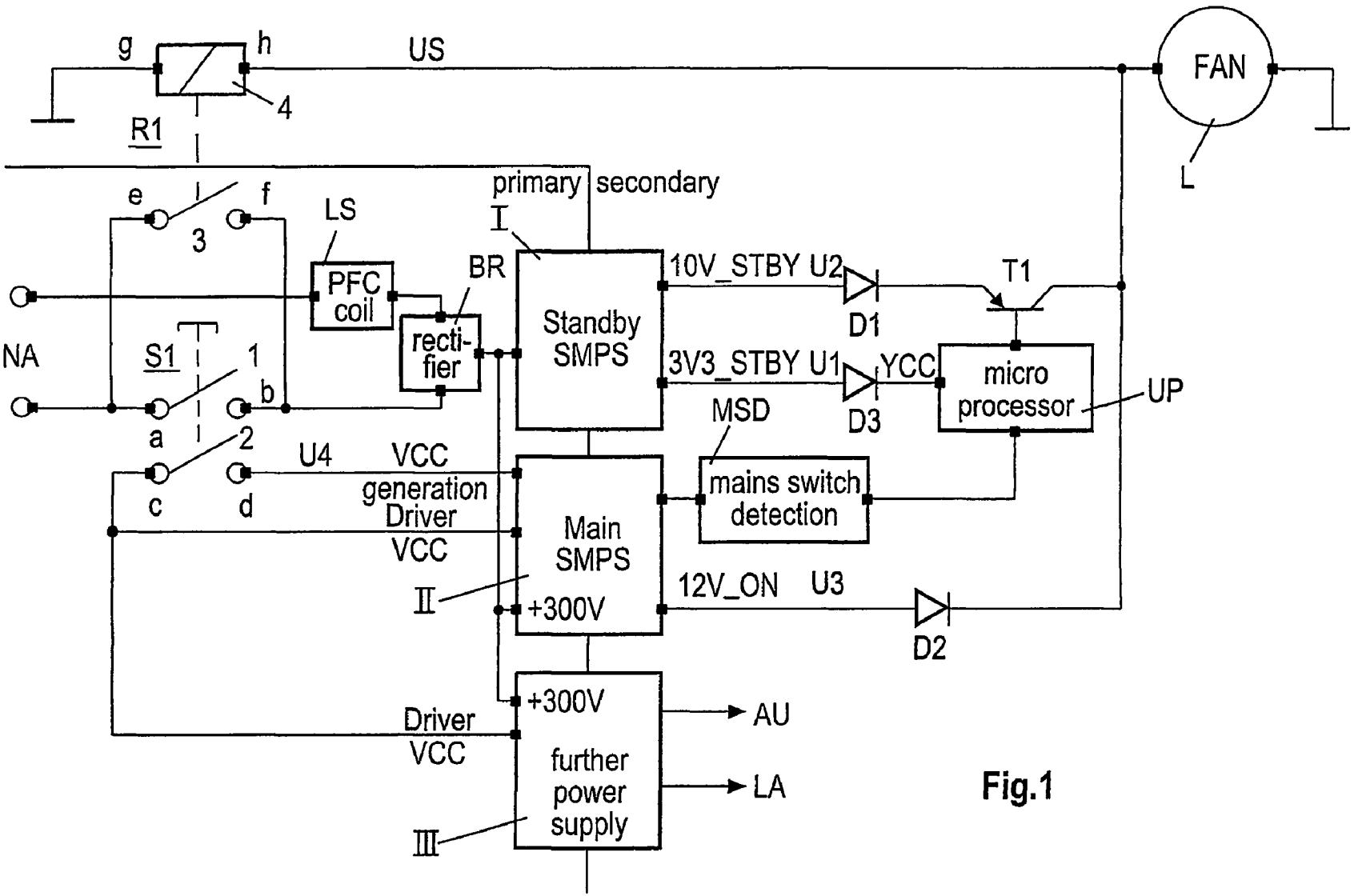

| | | |
|---|---|---|
| EP | 1120894 | 8/2001 |
| JP | 0380485 | 8/1991 |
| JP | 04053943 | 2/1992 |
| JP | 0487565 | 3/1992 |

* cited by examiner

CIRCUIT ARRANGEMENT HAVING A POWER SUPPLY UNIT

This application claims the benefit, under 35 U.S.C. §365 of International Application PCT/EP04/014763, filed Dec. 28, 2004, which was published in accordance with PCT Article 21(2) on July 28, 2005 in English and which claims the benefit of German patent application No. 102004001296.2, filed Jan. 8, 2004.

The present invention is based on a circuit arrangement having a power supply unit, a mains switch and having a switching element that bridges a first switching contact of the mains switch. Circuit arrangements of this type are used in devices appertaining to consumer electronics, by way of example.

For devices having a relatively high power consumption, specific specifications with regard to harmonic currents of the mains supply have become applicable in the meantime in various countries. In this case, the harmonic loading of the electricity mains by a device may be specified by a so-called power factor. Switch mode power supply units, in particular, effect a strongly pulsed loading of the mains supply, which leads to harmonic currents in the mains supply if they do not have corresponding circuit measures for improving the power factor.

Switch mode power supply units having a high power factor are disclosed in EP-A-0 700 145 and U.S. Pat. No. 5,986,898, by way of example. Another possibility for improving the power factor of a power supply unit is to use a coil in the input region of the power supply unit. Said coil is known as a mains frequency coil or power factor coil, by way of example, and has the function of an inductor that broadens the pulsed loading through the power supply unit. Switch mode power supply units having a coil in this respect are disclosed in WO 01/052908 A2 and WO 03/090335 A1, by way of example.

In the meantime, fans for cooling specific components, e.g. for cooling lamp units with a high-power lamp, have been arranged more frequently in devices appertaining to consumer electronics. High-power lamps are used in particular in back projectors or so-called beamers for image display. For these, the manufacturers specify a specific time, for example 1-2 minutes, for cooling the lamp unit after the device has been turned off, in order to be able to guarantee a sufficient service life therefor.

The run-on of a fan is not a problem if the corresponding device is changed over from a normal mode to a standby mode. However, if the device is completely switched off with the mains switch, then specific circuit means must be present in order to keep the fan in operation for a sufficiently long time.

The object of the invention is to specify a circuit arrangement of the type mentioned previously which ensures a delayed switch-off of a load, in particular of a fan, for a certain time when the circuit arrangement is turned off by means of a mains switch.

This object is achieved for the circuit arrangement by means of the features of claim 1. Advantageous developments of the invention are specified in the subclaims.

The circuit arrangement according to the invention has a power supply unit, a mains switch and a switching element that bridges a switching contact of the mains switch. In this case, a load, in particular a fan, is coupled to a control terminal of the switching element, so that when the switching element is opened, the load is simultaneously turned off.

The switching element is a relay, in particular, which maintains the connection to the mains supply for a certain time when the circuit arrangement is switched off and, in this case, also when the power supply unit is switched off by means of the mains switch. By virtue of the load being coupled to the control terminal of the switching element, the load is thereby simultaneously still kept in operation for a defined time after the switch-off, so that components can still be cooled for a sufficient time, by way of example, after the circuit arrangement has been turned off, when using a fan as the load. The delayed switch-off via the switching element simultaneously ensures that the energy stored in a power factor coil used for a power factor correction is reduced.

In a preferred exemplary embodiment, the circuit arrangement has a first power supply unit having a lower output power, for example for a standby mode, and a second power supply unit having a higher output power, which is in operation only in the normal mode of a corresponding device. In this case, a controller is supplied with an operating voltage by the first power supply unit, so that it is in operation even in the standby mode. If the device is switched off by a user by means of the mains switch, then the controller maintains the operation of the first power supply unit for a predetermined time, for example one to two minutes, via the switching element, for example a relay. Said time is chosen, in particular, such that a load can be cooled down sufficiently by means of the fan. At the same time, the delayed turn-off prevents an excessive wear of the mains switch due to the power factor coil.

The circuit arrangement is used in particular in a rear projection television set using a DLP (Digital Light Processing) unit. The latter comprises an integrated mirror circuit and a high-power lamp which, after the device has been turned off, must still be cooled for approximately 2 minutes in order that the mirror circuit, in particular, is not overheated. However, the arrangement can also be used in computer-controlled devices, by way of example, in which it is necessary to ensure that important data can still be stored after the device has been switched off. A microprocessor needs approximately 50 microseconds for this in order to store important data about the state of the device. The run-on time may also be chosen in such a way that relatively large quantities of data can be stored on a hard disk.

Figure 2:
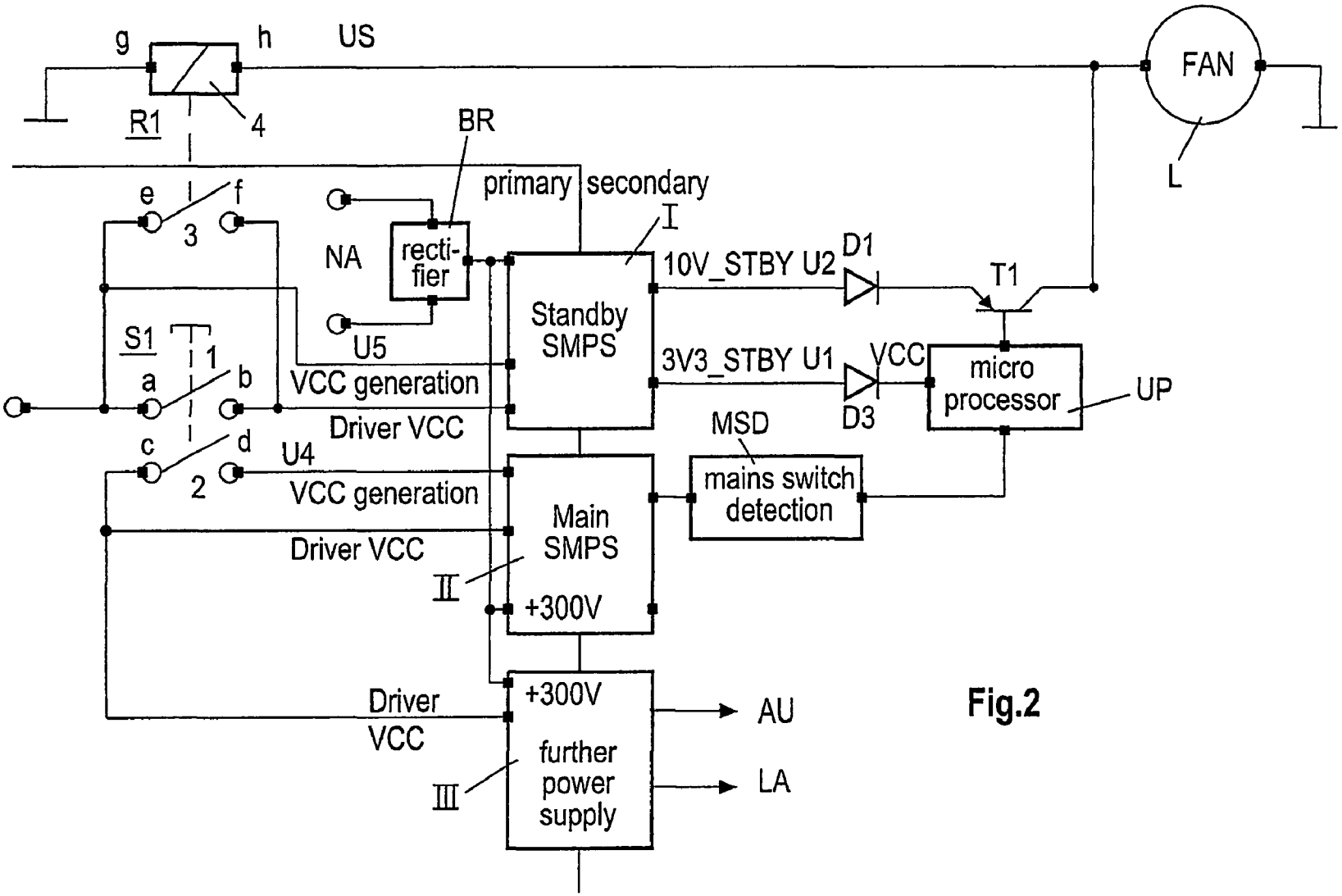

The invention is explained in more detail below by way of example with reference to schematic drawings, in which:

FIG. 1 shows a circuit arrangement having a power supply unit, a mains switch, a relay and a load and FIG. 2 shows a circuit arrangement similar to that of FIG. 1 but in which the switching contacts of the mains switch are used only for switching off supply voltages on the primary side.

FIG. 1 illustrates a circuit arrangement having a first power supply unit I, a mains switch S1 and a switching element, a relay R1 in this exemplary embodiment. The power supply unit I is supplied with a DC voltage U+ in a known manner via a rectifier BR, e.g. a bridge rectifier, which is connected to a mains terminal NA, said voltage being approximately 300 volts by way of example, given a mains AC voltage of 230 volts. Arranged between the rectifier BR and the mains terminal NA is a power factor coil LS for power factor correction. In this case, the power factor coil LS may, be arranged within the mains voltage feed line and in the mains voltage return line. However, it is likewise possible to arrange the power factor coil LS between the rectifier BR and a storage capacitor connected downstream.

The rectifier BR furthermore supplies a second power supply unit II and a third power supply unit III with the supply voltage U+. In this. case, the first power supply unit I is a power supply unit having a lower output power, in particular for a standby mode, and the power supply units II and III are power supply units having a higher output power which are in operation only in a normal mode.

Circuit arrangements having a switch mode power supply unit and a power factor coil are disclosed for example in the applications WO 01/052908 and WO 03/090335 already cited, to which reference is hereby. made. These have already referred to the problem of turning off a circuit arrangement by means of a mains switch since a power factor correction coil having a high inductance leads to an increased wear of the switching contacts of the mains switch when the circuit arrangement is switched off.

In order to avoid the wear of the mains switch S1, according to FIG. 1, a first switching contact 1 of the mains switch S1 is bridged by a switching contact 3 of the relay R1. In this case, the switching contact 1 is arranged between the mains terminal NA and the rectifier BR. The second switching contact 2 of the mains switch S1 is used for turning off a primary-side supply voltage U4 for the two power supply units II and III. The second switching contact 2 serves in particular for turning off a supply or control voltage U4 of a driver stage of the second power supply unit II, for example a rectified supply voltage Vcc.

As long as the circuit arrangement is switched on, the switching contact 3 of the relay R1 is kept closed by a controller UP, a microprocessor in this exemplary embodiment, by means of a control voltage Us, e.g. 10-12 V. If the circuit arrangement is switched off via the mains switch S1, then the two power supply units II and III are immediately turned off via the second switching contact 2 since the switching contact 2 interrupts the supply voltage U4.

The power supply unit I still remains in operation, however, since the switching contact I is bridged by the switching contact 3 of the relay R1 and the power supply unit I thereby continues to be supplied with the voltage U+. As a result, the controller UP also remains in operation since it is supplied with a supply voltage U1 by the power supply unit I via a diode D3. The controller UP is connected to a mains switch detection circuit MSD, which monitors the on/off state of the second power supply unit II, and thereby detects when the power supply unit II is switched off. The controller UP then opens the switching contact 3 of the relay R1, by means of the control voltage Us after a defined time, with the result that the first power supply unit I and thus the entire arrangement is thereby also switched off.

Since the first power supply unit I has only a very low power, for example a few watts, no harmful effects due to the inductance of the power factor coil LS arise when the standby power supply unit is turned off via the switching contact 3. The delayed switch-off of the standby power supply unit via a relay has already been described in the international application WO 01/052908 cited.

In this exemplary embodiment, the circuit arrangement is arranged in an image projection device, in particular in a back projector, which serves for displaying a television program or a computer image. The image projection device in this case uses a high-power lamp to be cooled, which is not illustrated, for displaying the image. The high-power lamp is supplied with a supply voltage by the power supply unit III via a terminal LA, by way of example. The power supply unit III additionally supplies audio amplifiers arranged in the image projection device via a terminal AU. The power supply unit II supplies, in particular, supply voltages for circuits for signal processing.

According to the invention, a load L is simultaneously coupled to the control terminal 4 of the switching element R1, so that when the switching voltage Us is turned off, the load L is simultaneously turned off. The load L is supplied with a supply voltage U3 via a diode D2. In this case, the supply voltage U3 simultaneously constitutes the switching voltage Us for the switching contact 4. Via a switch T1, a transistor in this exemplary embodiment, a supply voltage U2 can additionally be applied via a diode D1 to the load L and the switching contact 4. In this exemplary embodiment, the load L is a fan for cooling the high-power lamp.

The supply voltage U2 is preferably lower than the supply voltage U3 and is decoupled from the supply voltage U3 via a diode D1 arranged between the power supply unit I and the switch T1 if the switch T1 is open. The switch T1 may thereby also be open in the normal mode. This ensures, in the event of a failure of the supply voltage U3, that the fan L continues to be in operation.

The circuit arrangement functions as follows: In the normal mode, the supply voltage U3 is present at the fan L and at the switching contact 4, so that the fan is in operation for cooling the high-power lamp and the switching contact 3 of the relay R1 is closed. If the image projection device is then changed over into the standby mode, the two power supply units II and III are turned off in a known manner by the controller UP by means of a control signal passed to the primary side via an optocoupler. A circuit of this type is disclosed in U.S. Pat. No. 6,349,045 B1, by way of example. In particular, the image processing circuits and also the high-power lamp are thereby turned off.

In the event of changeover into the standby mode, the switch T1 is activated, so that the fan L remains switched on by means of the supply voltage U2 and the switching contact 3 is still closed. By means of a timer program of the controller UP, after a defined time, for example one to two minutes, the switch T1 is then closed, with the result that the fan L is turned off and the switching contact 3 is opened. As a result of this, the circuit arrangement furthermore remains in the standby mode since the mains switch S1 is closed.

From the standby mode, the image projection device can be changed over into the normal mode again by means of a remote control by virtue of the controller UP, in the event of an instruction in this respect from a remote control, switching on again the two power supply units II and III and also the high-power lamp and the corresponding circuits for signal processing. In this case, by means of the supply voltage U3, the fan L is simultaneously switched on and the switching contact 3 is closed.

If the image projection device is turned off via the mains switch S1, when it is in the normal mode, then the power supply units II and III are immediately switched off as a result of the switching contact 2 being opened. As a result of this, the signal processing circuits and the high-power lamp are also switched off. At the same time, the controller UP identifies by means of the circuit MSD that the power supply unit II has been switched off, and thus identifies that the mains switch S1 has been actuated. The controller UP then starts the timer program. In the normal mode, the switch T1 is preferably activated, so that as a result of this, after the image projection device has been switched off, the fan L also continues in operation for cooling the high-power lamp. The power supply unit I simultaneously remains switched on since the switching contact 3 remains closed by means of the control voltage US for the relay R1. It is only after the predetermined time of the timer program, which suffices for cooling down the high-power lamp, that the switch T1 is turned off, with the result that the fan L is turned off and the switching contact 3 is opened. The power supply unit I is also switched off as a result of this. The circuit arrangement is now completely turned off, with the result that the image projection device no longer consumes any energy and all of the circuits are deactivated.

If the image projection device is switched on via the mains switch S1, then the switching contacts 1 and 2 are closed. The bridge rectifier BR is now supplied with the mains voltage via the switching contact 1, with the result that the supply voltage U+ is available again for the power supply units I to III. As a result of this, the image projection device switches into the normal mode.

FIG. 2 illustrates a circuit arrangement that likewise has three power supply units I, II, III, a mains switch S1, a switching element R1, a controller UP and also a load L. Identical structural parts and also corresponding voltages are therefore provided with reference symbols as used in FIG. 1. In contrast to FIG. 1, however, here the switching contact 1 of the mains switch S1 is arranged for turning off a supply or control voltage of the power supply unit I. As a result of this, the mains voltage is present at the bridge rectifier BR via the mains terminal NA also when the device is switched off. A configuration of this type has already been described in the cited WO 03/090335.

The switching contact 1 of the mains switch S1 is used here for turning off a supply or control voltage U5 of the power supply unit I and the switching contact 2 is used for turning off a supply or control voltage U4 of the power supply units II and III. If the circuit arrangement is switched off by means of the mains switch S1, then the power supply units II and III are immediately switched off as a result of this. However, the power supply unit I still remains in operation as long as the switching contact 3 of the control element R1 remains closed.

Since, in this case as well, the switching contact 1 of the mains switch S1 is bridged by the switching contact 3 of the switching element R1, the power supply unit I and thus the fan L always remain in operation for the time set by the timer program until the switching contact 3 is opened by the timer program. This applies to all operating conditions of the arrangement if the arrangement is switched off by means of the mains switch S1, with the exception that the device is already in the standby mode. Therefore, the arrangement ensures that the fan L still remains in operation for a sufficient time after the arrangement has been turned off.

In the case of the arrangement according to FIG. 2, the energy consumption is slightly higher in the off state of the device. However, this does not lead to any impairment for a user and is not perceived by the latter. The arrangement according to FIG. 2 does not have a power factor correction coil. However, according to the invention it may likewise be equipped with a power factor correction coil upstream or downstream of the bridge rectifier BR.

In the exemplary embodiment according to FIG. 2, the load L and the switching element R1 are supplied with a supply voltage U2 only via the switch T1. For the controller UP, this does not mean any change, in principle, for the control of this arrangement. However, the power supply unit I must be constructed for a corresponding output power for operating the load L, and the switching contact 3 of the switching element R1 is always closed in the normal mode. In the case of the arrangement according to FIG. 1, by way of example, the load L can be operated with a higher voltage U3, e.g. 12 V, in the normal mode, and with a reduced voltage U2, e.g. 10 V, in the run-on mode of the timer program. Since the high-power lamp is already switched off in the run-on mode in the case of a back projection device, the cooling outlay may already be reduced here.

The power supply units I-III are, in particular, switch mode power supply units. However, the present invention is not restricted thereto. By way of example, a linear power supply unit may also be used for the low-power first power supply unit I. A semiconductor switch, for example a MOSFET, may also be used instead of a relay R1. With the use of a relay R1, however, it is possible to ensure a system isolation between the primary side and the secondary side of the power supply units in a simple manner.

For a person skilled in the art further applications of the invention lie within the scope of his customary activity. The invention may, in particular, also be realized with only one power supply unit I. The power supply unit I then supplies the supply voltages both for the standby mode and for the normal mode. Switch mode power supply units of this type are sufficiently known. A mains switch detection circuit may then be coupled via an opto-coupler and a voltage sense circuit with the mains switch for providing an information to the controller, when the mains switch is switched off. In case the appliance is switched off, the controller switches the appliance from the normal operation mode to the standby mode. Then, after a defined delay, the controller switches the appliance completely off.

The invention may, in particular, also be used for devices that do not require any power factor correction. It may be used in particular also within a computer for providing a delayed switch off such, that the CPU of the computer has sufficient time to shutdown the operating system.

The invention claimed is:

1. A circuit arrangement having
- a first power supply unit,
- a rectifier supplying a DC voltage for said power supply unit,
- a mains terminal,
- a mains switch having a first switching contact, arranged between the mains terminal and the rectifier, or arranged for turning off a supply or control voltage of a driver stage of the first power supply unit,
- a switching element with a control terminal, to which a control voltage is coupled, the switching element being coupled in parallel with said first switching contact of the mains switch for providing a current path bridging said first switching contact,
- a controller, which is supplied with an operating voltage by the first power supply unit, and which is coupled to said control terminal for control of the switching element, and
- a load coupled to said control terminal of the switching element for switching the load off substantially simultaneously when opening the switching element via the control voltage by means of the controller, and wherein the load is switched off and the switching element is opened in a delayed manner, when the circuit arrangement is switched off by means of the main switch.

2. The circuit arrangement as claimed in claim 1, wherein the controller is a microprocessor.

3. The circuit arrangement as claimed in claim 1, wherein the switching element is switched on and off by the controller via a switch arranged between an output voltage of the power supply unit and the control terminal.

4. The circuit arrangement as claimed in claim 1, wherein the load is a fan.

5. The circuit arrangement as claimed in claim 1, wherein an inductance for a power factor correction is arranged between a mains terminal and the power supply unit, in particular upstream of a bridge rectifier.

6. The circuit arrangement as claimed in claim 1, comprising a second power supply unit, wherein the first power supply unit has a lower output power and the second power supply unit has a higher output power, the second power supply unit being a switch mode power supply unit, and the circuit arrangement having a standby mode in which the second power supply unit is turned off.

7. The circuit arrangement as claimed in claim 6, wherein the load is supplied with an operating voltage by the second power supply unit via a decoupling element in the normal mode and is supplied with an operating voltage by the first power supply unit via a switch in the standby mode.

8. The circuit arrangement as claimed in claim 6, a second switching contact of the mains switch is used for turning off a supply or control voltage of a driver stage of the second power supply unit.

9. The circuit arrangement as claimed in claim 6, wherein a second switching contact of the mains switch is used for turning off a supply or control voltage of a driver stage of the second power supply unit.

10. The circuit arrangement as claimed in claim 2, wherein the microprocessor comprises a timer program for opening the switching element and for turning off the load.

11. The circuit arrangement as claimed in claim 1, comprising further a mains switch detection circuit coupled to the controller for sensing a switching off operation of the mains switch.

12. The circuit arrangement as claimed in claim 1, wherein the circuit arrangement is arranged in an image projection device, in particular a rear projection television set using a DLP (Digital Light Processing) unit, the image projection device having a das discharge lamp to be cooled which, after it has been switched off, has to be cooled for a defined time, i.e. approximately 1-2 minutes.

* * * * *